US005339605A

United States Patent [19]

Simpson, Sr. et al.

[11] Patent Number: 5,339,605

[45] Date of Patent: Aug. 23, 1994

[54] PRODUCT COMPRESSOR FOR SHRINK TUNNEL

[75] Inventors: Billy J. Simpson, Sr.; Terry F. Hinson, Sr., both of Oakboro, N.C.

[73] Assignee: Signature Packaging Machinery, Inc., Locust, N.C.

[21] Appl. No.: 29,877

[22] Filed: Mar. 11, 1993

[51] Int. Cl.[5] ..... B65B 1/24; B65B 53/02

[52] U.S. Cl. ..... 53/439; 53/442; 53/526; 53/557

[58] Field of Search ..... 53/439, 436, 526, 528, 53/523, 442, 557

[56] References Cited

U.S. PATENT DOCUMENTS

| | | | |
|---|---|---|---|
| 3,555,772 | 1/1991 | Kammer | 53/526 |
| 3,589,099 | 6/1971 | James | 53/557 X |
| 3,785,276 | 1/1974 | Noor | 53/557 X |
| 3,840,997 | 10/1974 | Lucas | 53/526 X |
| 4,858,416 | 8/1989 | Monaghan | 53/439 |
| 5,009,057 | 4/1991 | Wilkinson | 53/439 |

*Primary Examiner*—James F. Coan

*Attorney, Agent, or Firm*—Ralph H. Dougherty

[57] ABSTRACT

An improved shrink tunnel having an upper secondary conveyor in spaced relation to a lower main conveyor adapted to compress a wrapped product during an initial period of the product's journey through the shrink tunnel. In the preferred embodiment an outer drive roller is suspended over the main conveyor by an adjustable actuator arm with an inside idle roller being rotatably attached to the outside drive roller. Thus, the weight of the idle roller and side frame bars provide the compression. In operation a wrapped product is delivered to the main conveyor which conveys the product through the shrink tunnel. Prior to entering the shrink tunnel the upper surface of the wrapped product comes in contact with the secondary conveyor. The weight of idle roller and the side frames compress the package. During this time, the shrink wrap on the sides of the package is being shrunk by the heat. Upon leaving the secondary conveyor the shrink wrap on the top and bottom is exposed to the heat and is shrunk. As the sides have already been shrunk the product is constrained from expanding while the top and bottom shrinks.

16 Claims, 2 Drawing Sheets

PRODUCT COMPRESSOR FOR SHRINK TUNNEL

FIELD OF THE INVENTION

The present invention relates to a shrink tunnel for use in packaging of products in heat shrinkable plastic film, and more particularly to an apparatus and method for the compression of products during the heat shrinking operation.

BACKGROUND OF THE INVENTION

A common way of packaging many commercial products is to seal the product within a close fitting plastic film. This packaging is presently accomplished by loosely wrapping the article to be packaged in a heat shrinkable plastic film, sealing the abutting edges of the film to include the product and subjecting the package to sufficient heat to activate the shrinkage of the plastic film tightly around the product, producing a tightly wrapped package.

Machines commonly referred to as L-Sealers are commercially available to accomplish the preliminary wrapping procedure as above-described. Heat shrinkable plastic film in continuous sheets, pre-folded along the central longitudinal axis and packaged in convenient rolled form are utilized for this purpose. L-Sealing machines characteristically provide a sealing table for supporting the plastic film around the product, which is inserted between the folds of the film and a pair of L-shaped jaws at the table adapted for receiving and grippingly engaging the film therebetween. One of the jaws is provided with a heated wire sealing arrangement to simultaneously sever and seal the film along a continuous L-shaped seal line extending parallel to the folded edge of the film and transversely between the parallel seal extent and the folded edge. In a continuous operation the seal formed in making each package provides the initial transverse seal to the next package so that each L-sealing operation provides complete package formation.

The operation of heating the package formed in the L-sealing operation is carried out in a machine commonly referred to as a shrink tunnel. Such machines provide a substantially enclosed heating chamber though which travels a driven conveyor belt that transports the sealed package through the heating chamber for shrinkage of the plastic film.

The initial act of wrapping performed by the L-sealer tends to capture a small quantity of air between the wrapping and the package. Machines currently exist that produce perforations within the wrapping to allow this air to escape during the shrinking process, thus preventing the bursting of the wrap. An example of such an apparatus is disclosed in U.S. Pat. No. 5,015,325.

However, many products are delivered to the sealing tunnel that have not yet settled. For example, in the textile industry, the old method of folding sheets for packaging involved manually folding and compressing the sheets. It is the current practice to employ machines to perform the folding. Many of these folding machines are incapable of performing the compression step, and thus deliver to the packaging line loosely folded sheets. Even where the folding machines are capable of compressing the sheets, the time allowed between the folding and packaging steps is sufficient to allow them to "rise". Processing these loose sheets through current shrink wrapping machinery, produces packages that have varying degrees of "free space" and thus vary considerably in volume. Even where the product is fully compressed upon delivery to the shrink tunnel, the hot air inside the tunnel causes air trapped within the folds of the sheet to expand, producing variable amounts of free space in the final package.

The variance in the free space of textile packages is most typically seen as differences in height. As can be readily understood, this creates problems in shipping when the packaged sheets are boxed in preparation for delivery. It is not uncommon for a stack of packages of sheets to be manually compressed two inches in order to force the stack into the confines of a shipping container. This compression obviously wrinkles the sheets and bends the J-insert, diminishing the appeal to customers.

Boxed products are also difficult to package attractively. The air naturally contained within a box is expanded by the heat within the shrink tunnel. When the air cools the volume of the box diminishes, loosening the wrapping. Not only is this unattractive but the chance of the wrapping tearing during shipping is increased.

Another problem which occurs during the packaging process is where flimsy products, such as leaflets, are bent due to the shrinking action of the wrap. There currently exists no practicable automated method for ensuring such bending does not happen.

SUMMARY OF THE INVENTION

This invention provides an apparatus for insuring consistent height in shrink wrapped packages processed through an L-sealer and shrink tunnel. Specifically, an upper axial conveyor belt is provided to maintain a preset product height during the initial entry into the shrink tunnel. While the product is in transit between the two conveyors, the wrap on the sides of the package is fully shrunk to hold the package at the preset height. After the package exits the top conveyor, the hot air shrinks the top and bottom of the wrapping, thereby fully shrinking the wrap around the package.

The present invention is particularly useful for shrink wrapping packages comprising textiles wherein the products have a substantial amount of free space when delivered for packaging. The conveyor act to compress the textile product, removing any air trapped between the folds. This produces a final package that is tightly wrapped and highly attractive. Further, as the package is fully compressed to a preset height, space is saved when boxing the packages for shipping.

The invention is also useful to ensure that a box does not expand in the shrink tunnel during the heating process. The invention is further useful in wrapping flimsy products which are likely to bend when processed using currently available machines and currently used methods.

OBJECTS OF THE INVENTION

The principal object of this invention is to provide an improved shrink tunnel apparatus capable of controlling the height of the resultant shrink wrapped package.

A further object of this invention is to provide a method for controlling the height of a shrink wrapped package though the shrink tunnel.

Another object of this invention is to provide an apparatus to insure that packages processed though an L-sealer and a shrink tunnel are fully compressed and have no free space within the package.

Another object of this invention is prevent shrink wrap from distorting flimsy products through its shrinking action.

BRIEF DESCRIPTION OF THE DRAWINGS

The foregoing and other objects will become more readily apparent by referring to the following detailed description and the appended drawings in which.

DETAILED DESCRIPTION

Figure 1:
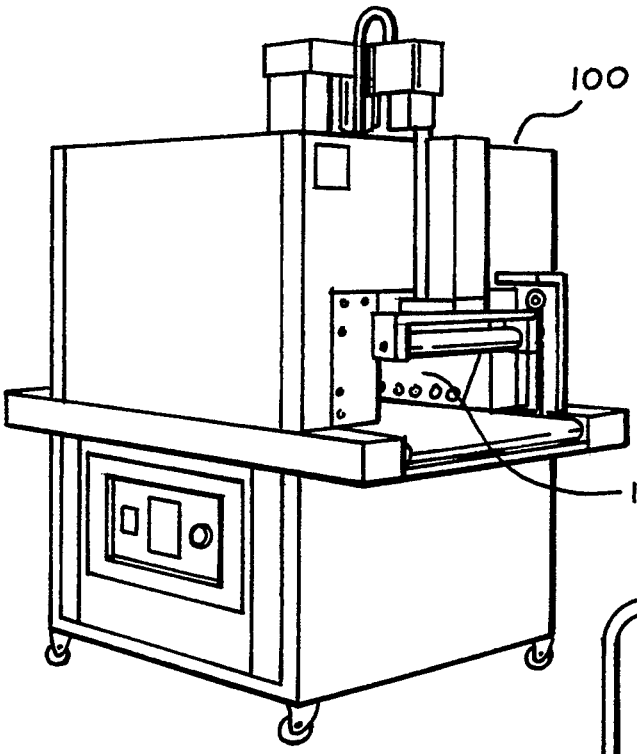
FIG. 1 is an isometric view of a shrink tunnel showing the preferred embodiment of the compression apparatus.
Figure 2:
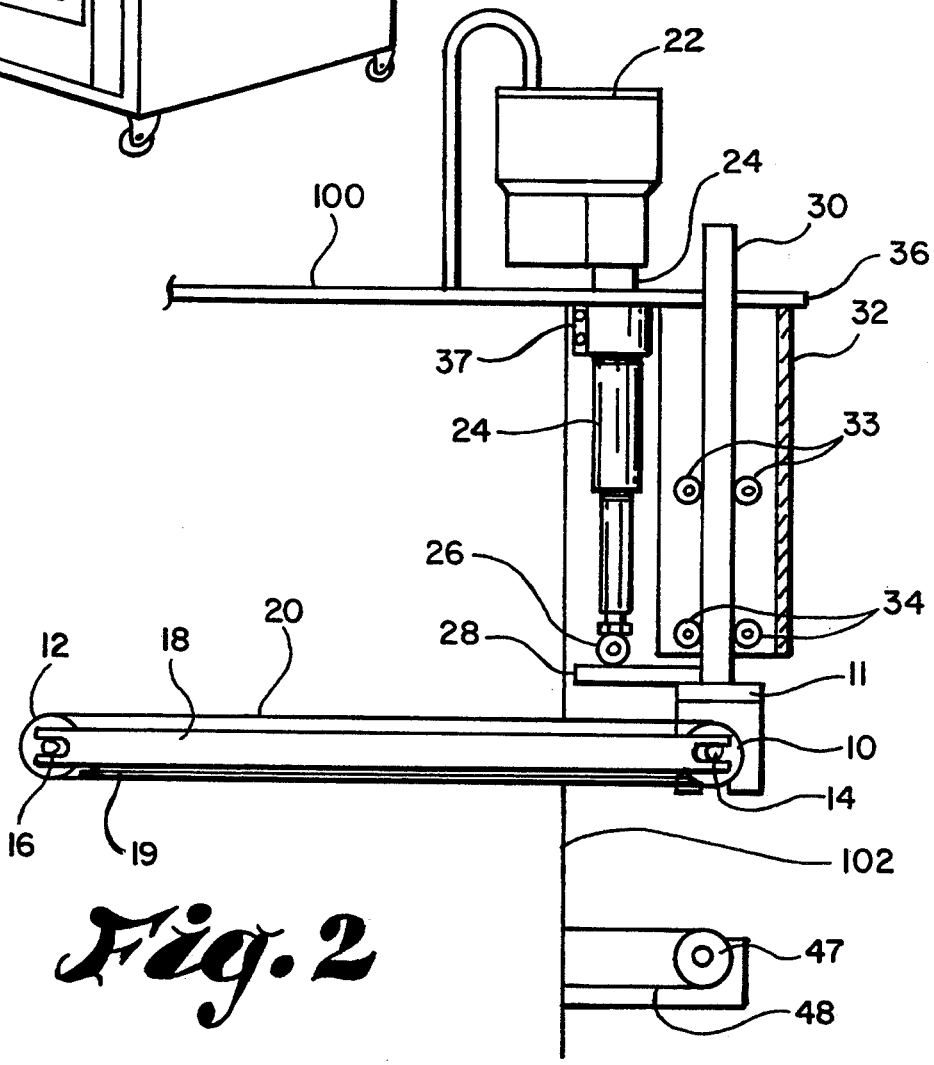
FIG. 2 is a side view of the preferred embodiment of the compression apparatus.
Figure 3:
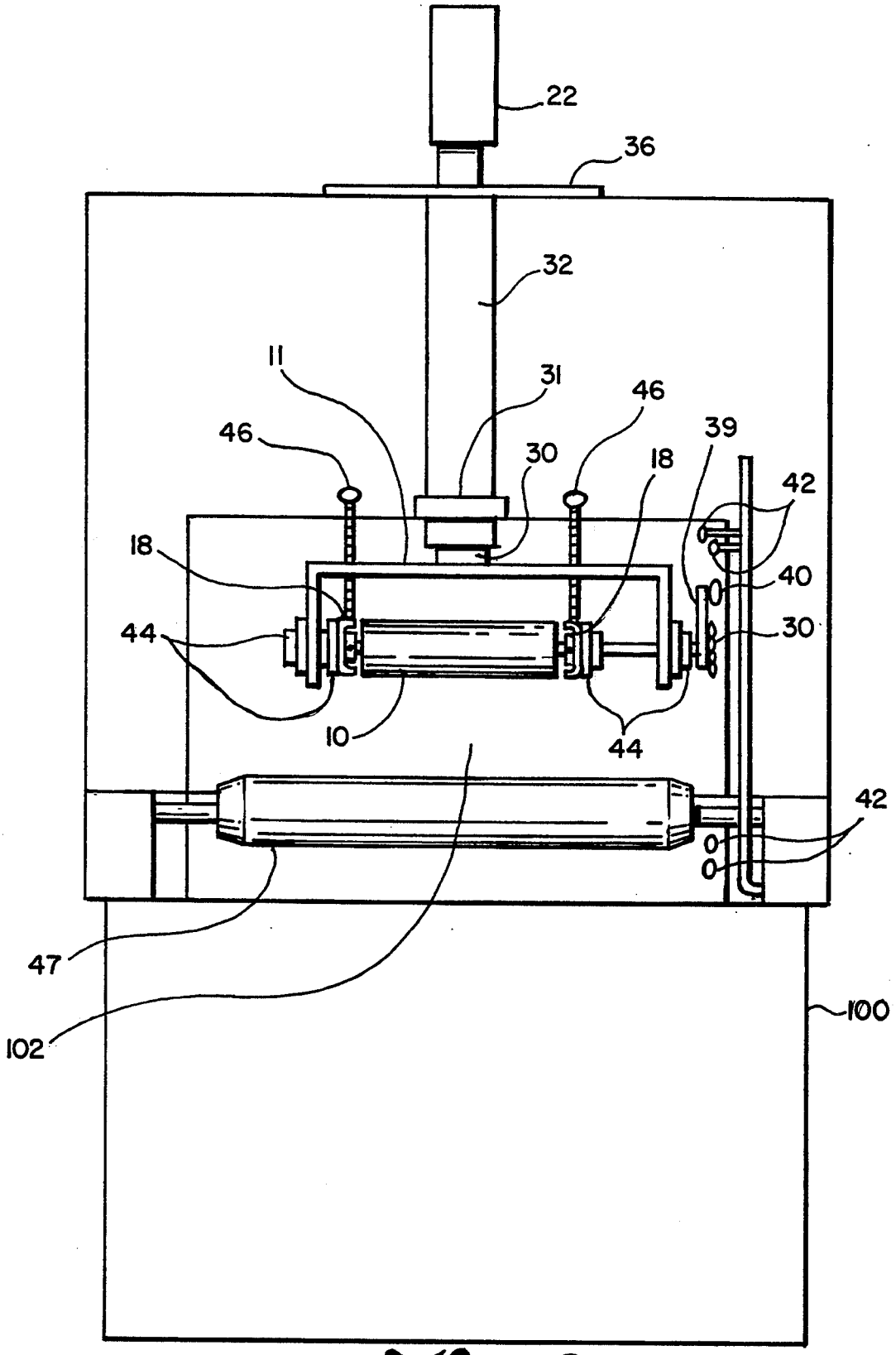
FIG. 3 is a front view of the preferred embodiment of the compression apparatus.

Referring now to the drawings, the invented product compressor for shrink tunnels in its preferred embodiment is shown in FIG. 1. In its most basic form the compression device is a secondary conveyor situated above the main conveyor onto which the wrapped product is delivered for processing through the shrink tunnel. The secondary conveyor extends from just in front of the entrance to the shrink tunnel, into the heating chamber of the shrink tunnel, and serves to compress the wrapped package during the initial stages of shrinking.

In the preferred embodiment, the secondary conveyor includes a driven roller 10, having a drive shaft 14, from which extends a pair of side frame bars 18 rotatably attached to shaft 14 via pillow blocks 44. Rotatably attached to the opposite end of the side frames 18, via pillow blocks, is idle shaft 16, having idle roller 12 thereupon. Idle shaft 16 is adjustably attached to side frame bars to allow for adjustments in the tracking of the belt. Attached to side frames 18 and extending downward therefrom is product plate 19, which serves to provide a firm surface for the compression of product. Wrapped around both rollers in the conventional manner is conveyor belt 20. While the secondary conveyor can be of any length, two feet has been determined to be the optimal length for most applications involving standard 40 or 60 inch tunnels. The width of the product compressor conveyor belt 20 is determined by the size of the packages to be processed.

The secondary conveyor assembly is adjustably held in place via actuator arm 24, which is vertically mounted in front of shrink tunnel entrance 102, via bracket 37 on mounting plate 36. Mounting plate 36 is fixably attached to the top of shrink tunnel 100, and extends out over the lower idle roller 47 of the main conveyor. Motor 22 is mounted on top of actuator arm 22 and is adapted to cause the arm to reciprocate vertically, allowing adjustment in the height of the secondary conveyor relative to the main conveyor. Rotatably attached to the end of actuator arm 24, via joint 26, is actuator mounting angle 28, which extends away from shrink tunnel entrance 102, and is fixably attached to the drive roller bracket 11.

The rotational orientation of drive roller bracket 11 with respect to shrink tunnel entrance 102 is maintained by slide tube 30 which is fixably attached to drive roller bracket 11 and extends upward therefrom. Slide tube 30 passes between roller pairs 33 and 34 rotatably attached inside slide tube housing 32. Roller pairs 33 and 34 are mounted within slide tube housing 32 with their shafts parallel to both the floor and the front housing of shrink tunnel 100. Slide tube housing 32 is fixably attached to mounting plate 36 and depends downward therefrom. Slide tube 30 extends upward through an opening in mounting plate 36 to provide a visual indicator of the relative height of the conveyor assembly.

The drive roller of the secondary conveyor assembly is rotatably attached to drive roller bracket 11, via pillow blocks 44, and extends into shrink tunnel 102. In the preferred embodiment of the invention, it is the weight of the idle roller and the side frames pivoting about drive shaft 14 that compresses the wrapped products. Angle adjusting rods 46 extend from the top of drive roller bracket 11 and act against the tops of side frames 18 to constrain the downward rotation of the side frames. Thus, by extending or retracting the angle adjusting rods 46, the maximum amount of compression can be set.

Drive roller 10 is driven via reverse drive gear 38 fixably attached to the end of drive shaft 14. In most shrink tunnels the main conveyor is driven via a motor located on the exit side of the tunnel. In order to maintain the speed of the secondary conveyor equal to that of the main conveyor, the same motor is used to drive both conveyors. Both conveyors must use the same diameter gears to ensure uniform operation- In operation the drive chain normally present to drive the main conveyor is lengthened to extend through the housing of shrink tunnel 100. The chain is then brought up the face of the housing next to tunnel entrance 102 via a system of idle rollers 42. The chain is brought into contact with reverse drive gear 38 and held in place by reverse idle roller 40 rotatably attached to idle block 39. Idle block 39 is in turn rotatably attached to drive shaft 14. Through this system, a reverse rotation is applied to the upper conveyor. In other words, both the upper surface of the main conveyor and the lower surface of the secondary conveyor move toward the tunnel at the same surface speed measured in feet per minute.

The height of drive roller 10 above main belt 48 is set via actuator arm 24. For sheet sets, drive roller 10 is set slightly lower than the height of the package as delivered to the shrink tunnel. In the case of boxed goods, drive roller 10 is set slightly higher than the box. The angle of sidearms 18, and thus the conveyor assembly, is set to control the amount of compression by constraining the rotation of side frames 18. The product is then delivered, wrapped, to main conveyor 47 which conveys the product through the shrink tunnel. Prior to entering the shrink tunnel the wrapped product comes in contact with the secondary conveyor. The weight of idle roller 12 and the side frames 18 compress the package. This compression continues until either the weight of the secondary conveyor is taken by angle adjusting rods 46 or the product leaves the secondary conveyor. During this time, the shrink wrap on the sides of the package is being shrunk by the heat. Upon leaving the secondary conveyor the shrink wrap on the top and bottom is exposed to the heat and is shrunk. As the sides have already been shrunk, the product is constrained from expanding while the top and bottom shrinks.

This gradual, as opposed to abrupt compression, helps maintain the attractive appearance of the products being processed through the shrink tunnel. The free-swinging action of the secondary conveyor ensures that the product is only compressed and not crushed.

ALTERNATIVE EMBODIMENTS

In its preferred embodiment, the invention is set up to process textile products being packaged, either by themselves or with a J-insert. The invention can be varied to handle a variety of products or installation schemes. As noted above, the width and length of the upper conveyor can be varied. Further, idle roller can be fixed in place either at an angle or substantially horizontal.

In the preferred embodiment, the secondary conveyor is driven to reduce the load on the main conveyor. However, if the main conveyor is powerful enough the secondary conveyor can be idle. Or the secondary conveyor can be driven off a different motor than the main conveyor, as long as both travel the same speed.

Lastly, various methods other than those presented here can be used to adjust the height of the conveyor. The secondary conveyor can even be fixed at a particular height for those units that only process a single product.

SUMMARY OF THE ACHIEVEMENT OF THE OBJECTS OF THE INVENTION

From the foregoing, it is readily apparent that we have invented apparatus and method for compressing a product during the heat shrinking process to reduce the free space in a package and control the height of the package.

What is claimed is:

1. A compression apparatus for a plastic film heat shrinking machine adapted for shrinking thermoplastic sheeting around a product, said shrinking machine having a substantially enclosed heating chamber having a housing provided with an entrance and exit, said shrinking machine having a main driven conveyor belt adapted to convey said product through said chamber, said main conveyor extending from in front of said entrance, through said heating chamber, beyond said exit, comprising:

a secondary conveyor having upper and lower stretches;

said conveyor having outside and inside rollers, with an endless belt mounted over said rollers;

said outside roller being positioned outside of said entrance to said heating chamber and above said main driven conveyor;

said inside roller being positioned within said heating chamber and above said main driven conveyor;

said inside roller being closer to said main driven conveyor belt than said outside roller; and said belt having an outer surface adapted to compress said product and an inner surface in contact with said rollers;

whereby said product is compressed between said main driven conveyor and said secondary conveyor.

2. A compression device according to claim 1 further comprising:

means for adjusting the vertical distance between said secondary conveyor and said main driven conveyor.

3. A compression device according to claim 1 wherein said inside roller is spaced from and pivotally attached to said outside roller, whereby the weight of said inside roller compresses said product.

4. A compression apparatus for a plastic film heat shrinking machine adapted for shrinking thermoplastic sheeting around a product, said shrinking machine having a substantially enclosed heating chamber having a housing provided with an entrance and exit, said shrinking machine having a main driven conveyor belt adapted to convey said product through said chamber, said main conveyor extending from in front of said entrance, through said heating chamber, beyond said exit, comprising:

a secondary conveyor having upper and lower stretches;

said conveyor having outside and inside rollers, with an endless belt mounted over said rollers;

said outside roller being positioned outside of said entrance to said heating chamber and above said main driven conveyor;

said inside roller being positioned within said heating chamber and above said main driven conveyor;

said inside roller being spaced from and pivotally attached to said outside roller; and said belt having an outer surface adapted to compress said product and an inner surface in contact with said rollers;

whereby the weight of said inside roller compresses said product.

5. A compression apparatus according to claim 4 wherein said outside roller is positioned outside of said entrance to said heating chamber and above said main driven conveyor; and said inside roller is positioned outside of said exit to said heating chamber and above said main driven conveyor.

6. A compression apparatus according to claim 4 wherein said outside roller is positioned inside of said entrance to said heating chamber and above said main driven conveyor; and said inside roller is positioned inside of said exit to said heating chamber and above said main driven conveyor.

7. A compression apparatus according to claim 4 wherein said outside roller is positioned inside of said entrance to said heating chamber and above said main driven conveyor; and said inside roller is positioned outside of said exit to said heating chamber and above said main driven conveyor.

8. A method of shrinking thermoplastic sheeting around a product comprising:

wrapping the product with thermo plastic sheeting;

sealing the sheeting about the product;

compressing the product while passing the product through a substantially enclosed heating chamber and maintaining the heat in the chamber at a temperature sufficient to shrink the sheeting;

ceasing compression when the sheeting has shrunk enough to hold the product in substantially the configuration the product assumed during the compression;

continuing to pass the product through the heating chamber until the sheeting is tightly wrapped about said product.

9. A method according to claim 8 wherein said temperature in said chamber is maintained from about 200 degrees to about 300 degrees fahrenheit.

10. A compression apparatus for a plastic film heat shrinking machine adapted for shrinking thermoplastic sheeting around a product, said shrinking machine having a substantially enclosed heating chamber having a housing provided with an entrance and exit, said shrinking machine having a main driven conveyor belt adapted to convey said product through said chamber, said main conveyor extending from in front of said entrance, through said heating chamber, beyond said exit, comprising:

a secondary conveyor having upper and lower stretches;

said conveyor having outside and inside rollers, with an endless belt mounted over said rollers;

said outside roller being positioned outside of said entrance to said heating chamber and above said main driven conveyor;

said inside roller being positioned within said heating chamber and above said main driven conveyor;

said belt having an outer surface adapted to compress said product and an inner surface in contact with said rollers;

means for driving said outside roller such that said belt travels over said lower stretch from said outside roller to said inside roller;

said inside roller being spaced from and pivotally attached to said outside roller; and whereby the weight of said inside roller compresses said product.

11. A compression apparatus for a plastic film heat shrinking machine adapted for shrinking thermoplastic sheeting around a product, said shrinking machine having a substantially enclosed heating chamber having a housing provided with an entrance and exit, said shrinking machine having a main driven conveyor belt adapted to convey said product through said chamber, said main conveyor extending from in front of said entrance, through said heating chamber, beyond said exit, comprising:

a secondary conveyor having upper and lower stretches;

said conveyor having outside and inside rollers, with an endless belt mounted over said rollers;

said outside roller being positioned outside of said entrance to said heating chamber and above said main driven conveyor;

said inside roller being positioned within said heating chamber and above said main driven conveyor;

said belt having an outer surface adapted to compress said product and an inner surface in contact with said rollers;

means for driving said outside roller such that said belt travels over said lower stretch from said outside roller to said inside roller;

said inside roller being closer to said main driven conveyor belt than said outside roller; and whereby said product is compressed between said main driven conveyor and said secondary conveyor.

12. A compression device according to claim 11 further comprising:

means for adjusting the vertical distance between said secondary conveyor and said main driven conveyor.

13. A compression device according to claim 12 wherein said inside roller is spaced from and pivotally attached to said outside roller, whereby the weight of said inside roller compresses said product.

14. A compression apparatus according to claim 13 wherein said means for adjusting the vertical distance between said secondary conveyor and said main driven conveyor is an actuator arm fixably attached to said housing of said heating chamber over said entrance, said actuator arm being adapted to reciprocate vertically over said main driven conveyor.

15. A compression device according to claim 14 further comprising:

said actuator arm being rotatably attached to a first bracket;

said first bracket being fixably attached to a second bracket;

said second bracket being rotatably attached to said outside roller;

said second bracket having an alignment bar depending upwardly; and, means for maintaining said alignment bar in position relative to said housing of said heating chamber.

16. A compression apparatus for a plastic film heat shrinking machine adapted for shrinking thermoplastic sheeting around a product, said shrinking machine having a substantially enclosed heating chamber having a housing provided with an entrance and exit, said shrinking machine having a main driven conveyor belt adapted to convey said product through said chamber, said main conveyor extending from in front of said entrance, through said heating chamber, beyond said exit, comprising:

a secondary conveyor having upper and lower stretches;

said conveyor having outside and inside rollers, with an endless belt mounted over said rollers;

said outside roller being positioned outside of said entrance to said heating chamber and above said main driven conveyor;

said inside roller being positioned within said heating chamber and above said main driven conveyor;

said inside roller being spaced from and pivotally attached to said outside roller;

said belt having an outer surface adapted to compress said product and an inner surface in contact with said rollers; and means for adjusting the vertical distance between said secondary conveyor and said main driven conveyor; and whereby the weight of said inside roller compresses said product.

* * * * *

US005339605B1

REEXAMINATION CERTIFICATE (3590th)

United States Patent [19] [11] B1 5,339,605

Simpson, Sr. et al. [45] Certificate Issued Aug. 4, 1998

[54] PRODUCT COMPRESSION FOR SHRINK TUNNEL

[75] Inventors: Billy J. Simpson, Sr.; Terry F. Hinson, Sr., both of Oakboro, N.C.

[73] Assignee: Signature Packaging Machinery, Inc., Locust, N.C.

Reexamination Request:
No. 90/004,742, Sep. 4, 1997

Reexamination Certificate for:

| | |
|---|---|
| Patent No.: | **5,339,605** |
| Issued: | **Aug. 23, 1994** |
| Appl. No.: | **29,877** |
| Filed: | **Mar. 11, 1993** |

[51] Int. Cl.[6] ..... B65B 1/24; B65B 53/02

[52] U.S. Cl. ..... 53/439; 53/442; 53/526; 53/557

[58] Field of Search ..... 53/439, 436, 526, 53/528, 523, 442, 557

[56] References Cited

U.S. PATENT DOCUMENTS

| | | | |
|---|---|---|---|
| 2,525,651 | 10/1950 | Clunan . | |
| 4,592,193 | 6/1986 | Gustavsson | 53/530 |
| 5,009,057 | 4/1991 | Wilkinson | 53/439 |

OTHER PUBLICATIONS

KPC–Master's Craft Int'l. Inc., "CT Series Compression Shrink Tunnels", One page.

*Primary Examiner*—James F. Coan

[57] ABSTRACT

An improved shrink tunnel having an upper secondary conveyor in spaced relation to a lower main conveyor adapted to compress a wrapped product during an initial period of the product's journey through the shrink tunnel. In the preferred embodiment an outer drive roller is suspended over the main conveyor by an adjustable actuator arm with an inside idle roller being rotatably attached to the outside drive roller. Thus, the weight of the idle roller and side frame bars provide the compression. In operation a wrapped product is delivered to the main conveyor which conveys the product through the shrink tunnel. Prior to entering the shrink tunnel the upper surface of the wrapped product comes in contact with the secondary conveyor. The weight of idle roller and the side frames compress the package. During this time, the shrink wrap on the sides of the package is being shrunk by the heat. Upon leaving the secondary conveyor the shrink wrap on the top and bottom is exposed to the heat and is shrunk. As the sides have already been shrunk the product is constrained from expanding while the top and bottom shrinks.

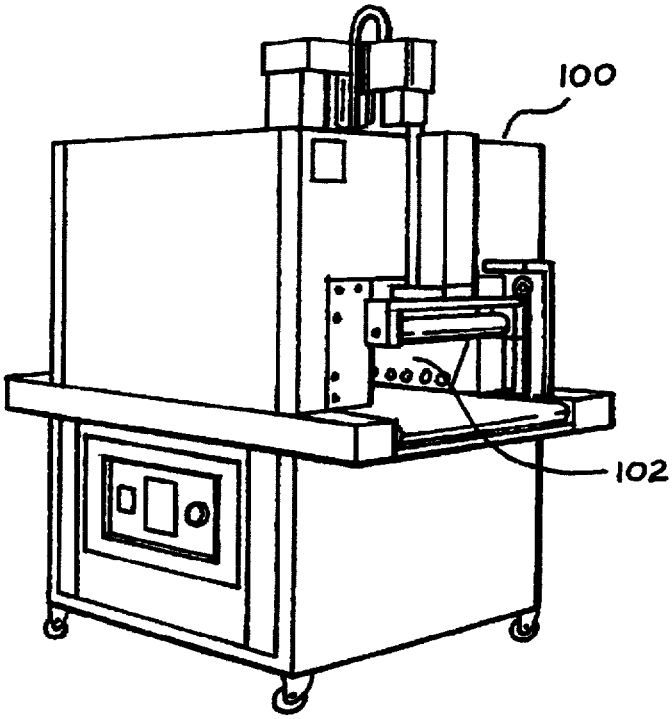

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–16 is confirmed.

* * * * *